US008305285B2

(12) United States Patent
Lee

(10) Patent No.: US 8,305,285 B2
(45) Date of Patent: Nov. 6, 2012

(54) WIRELESS COMMUNICATION MODULE

(75) Inventor: Jinsik Lee, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 336 days.

(21) Appl. No.: 12/806,689

(22) Filed: Aug. 19, 2010

(65) Prior Publication Data

US 2011/0043426 A1 Feb. 24, 2011

(30) Foreign Application Priority Data

Aug. 19, 2009 (KR) ..... 10-2009-0076657

(51) Int. Cl.
*H01Q 1/48* (2006.01)

(52) U.S. Cl. ..... 343/848; 343/893; 343/702

(58) Field of Classification Search ..... 343/702, 343/848, 893
See application file for complete search history.

(56) References Cited

U.S. PATENT DOCUMENTS

| | | | | |
|---|---|---|---|---|
| 6,448,933 | B1 * | 9/2002 | Hill et al. | 343/702 |
| 7,358,927 | B2 * | 4/2008 | Luebke et al. | 343/907 |
| 2004/0257283 | A1 * | 12/2004 | Asano et al. | 343/702 |
| 2005/0062657 | A1 * | 3/2005 | Lin | 343/702 |
| 2006/0061512 | A1 * | 3/2006 | Asano et al. | 343/702 |
| 2007/0013602 | A1 * | 1/2007 | Atkinson et al. | 343/873 |

FOREIGN PATENT DOCUMENTS

| | | |
|---|---|---|
| KR | 10-2005-0054478 A | 6/2005 |
| KR | 10-2007-006219 A | 6/2007 |

OTHER PUBLICATIONS

Office Action dated Feb. 17, 2011 in Korean Application No. 10-2009-0076657, filed Aug. 19, 2009.

* cited by examiner

*Primary Examiner* — Don Le
(74) *Attorney, Agent, or Firm* — Saliwanchik, Lloyd & Eisenschenk

(57) ABSTRACT

Disclosed herein is a wireless communication module, wherein a module substrate provided with components of a communication circuit part for the wireless communication module and having a ground pattern and a power feeding pattern is provided thereon with a shield can type antenna, the shield can type antenna comprises a ground area, a plurality of curved parts formed by downwardly curving both up/down and left/right side surfaces of the ground area, and an antenna part provided at the outer side of the curved part formed at both left/right side surfaces of the ground area.

10 Claims, 3 Drawing Sheets

WIRELESS COMMUNICATION MODULE

CROSS-REFERENCE TO RELATED APPLICATION

This application claims the benefit under 35 U.S.C. §119 of Korean Application No. 10-2009-0076657, filed Aug. 19, 2009, which is hereby incorporated by reference in their entirety.

BACKGROUND

1. Field of the Invention

The present invention relates to a wireless communication module.

2. Description of the Related Art

A mobile communication terminal such as a cell phone, a smart phone and a PDA (Personal Digital Assistant) provides various services based on a communication function.

A wireless communication module for providing a specific communication function largely has a similar configuration.

Therefore, integration components used in a wireless communication in a unit space and mounting the same on various products facilitate the implementation of a communication function.

Normally, a wireless communication module is provided with a communication circuit part comprised of each component including integrated chips in the upper surface of a module substrate, and the communication circuit part is screened by a shield can for screening electronic waves.

And, an antenna mounting unit is formed on one side area of the module substrate, and the antenna mounting unit is provided with a miniaturized antenna such as chip antennas and a PIFA (Planar Inverted F Antenna).

A given wireless signal processed in the communication circuit unit is transmitted/received via an antenna provided at the antenna mounting unit.

Such a wireless communication module provides a mobile communication terminal with a communication function for example, by being provided on a main substrate of a mobile communication terminal and interoperating with a system of a mobile communication terminal.

Considering the size of the mobile communication terminal is gradually small-sized and supporting functions successively increase, there have been continuous efforts to integrate much more electronic components into a smaller space.

And, in the wireless communication module field, an endeavor to improve spatial efficiency while compensating a transmission/reception function has been continuously made.

However, because the wireless communication module is provided with antennas by forming an antenna mounting part on one side of a module substrate, there is a limitedness in miniaturizing its size due to an area of an antenna mounting part.

BRIEF SUMMARY

In accordance with a wireless communication module of the present invention, a module substrate provided with components of a communication circuit part and having a ground pattern and a power feeding pattern is provided thereon with a shield can type antenna.

The shield can type antenna may include a ground area, a plurality of curved parts formed by downwardly curving both up/down and left/right side surfaces of the ground area, and an antenna part provided at the outer side of the curved part of both left/right side surfaces of the ground area.

Curved parts respectively downwardly curved at the upper and lower parts of the module substrate may be electronically connected to the ground pattern via the module substrate.

Components of the communication circuit part provided on the module substrate may be positioned within a space part forming of the ground area and the plurality of curved parts to shield electronic waves produced from the communication circuit part.

A radiation patch of the antenna part may be positioned in parallel with curved parts downwardly curved at both left/right side surfaces of the ground area, and the antenna part may have a power feeding part connecting the power feeding pattern to the radiation patch as well as a connection part, and the connection part may connect the radiation patch to the ground area.

The antenna part may include a PIFA (Planar Inverted-F Antenna).

Also, the antenna part may include a first antenna and a second antenna, respectively parallel disposed with curved parts downwardly curved at both left/right side surfaces of the ground area, and each of the first antenna and the second antenna may include a radiation patch parallel positioned with a respective curved part downwardly curved at both left/right side surfaces of the ground area, a power feeding part connecting the power feeding pattern to the radiation patch and a connection part connecting the radiation patch and the ground area to be integrally configured.

The power feeding pattern may be electrically connected to the power feeding pattern via the module substrate.

Each of the first antenna and the second antenna may include a PIFA (Planar Inverted-F Antenna), where the first antenna may be a main antenna transceiving a radio signal and the second antenna may include a diversity antenna receiving a radio signal.

DETAILED DESCRIPTION

The following detailed description is by method of example, and merely illustrative of embodiments of the invention. In addition, the principle and concept of the present invention will be provided for the purpose of the most useful and easy description.

Thus, it should be noted that unnecessary and detailed structures in the basic understanding of the present invention have not been provided, and several kinds of forms possibly practiced by one skilled in the art from the substance of the invention will be exemplified through the drawings.

Hereinafter, a wireless communication module in which a superiorly spatial efficient antenna of the invention is provided on a module substrate for a possible size miniaturization will be described with reference to the planar views and perspective views of FIGS. 1 through 4.

Figure 1:
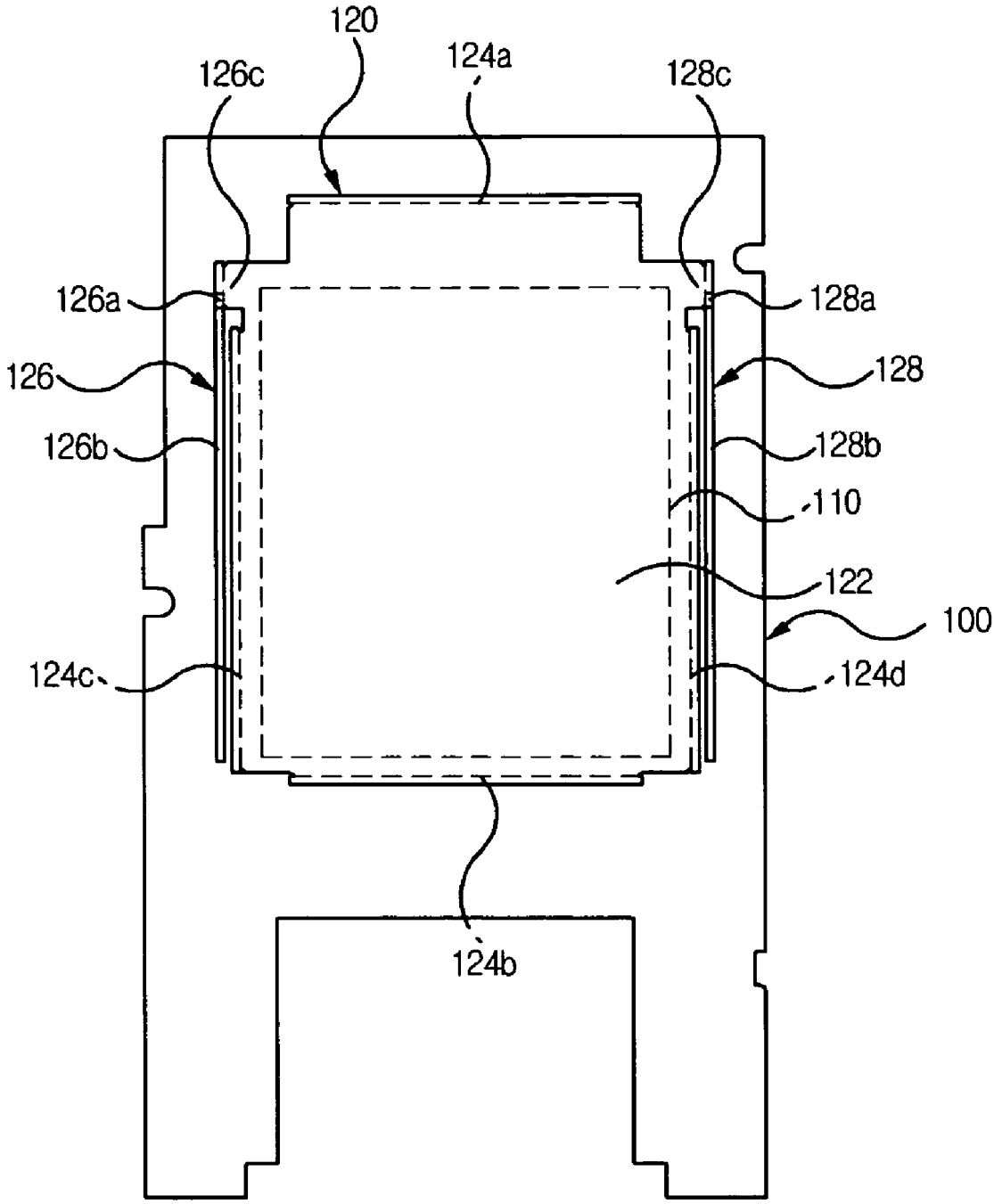
FIG. 1 is a planar view showing the construction of a wireless communication module of the invention.

FIG. 1 is a planar view showing the construction of a wireless communication module of the present invention.

Herein, a reference number 100 is a module substrate. The module substrate 100 uses a PCB (Printed Circuit Board) or a ceramic substrate such as HTCC (High Temperature Co-fired Ceramic) or LTCC (Low Temperature Co-fired Ceramic).

On the upper surface of the module substrate 100, a communication circuit part 110 comprised of each kind of component including a RF (Radio Frequency) chip and an integrated chip is provided.

A reference number 120 is a shield can type antenna formed of metal material.

Figure 2:
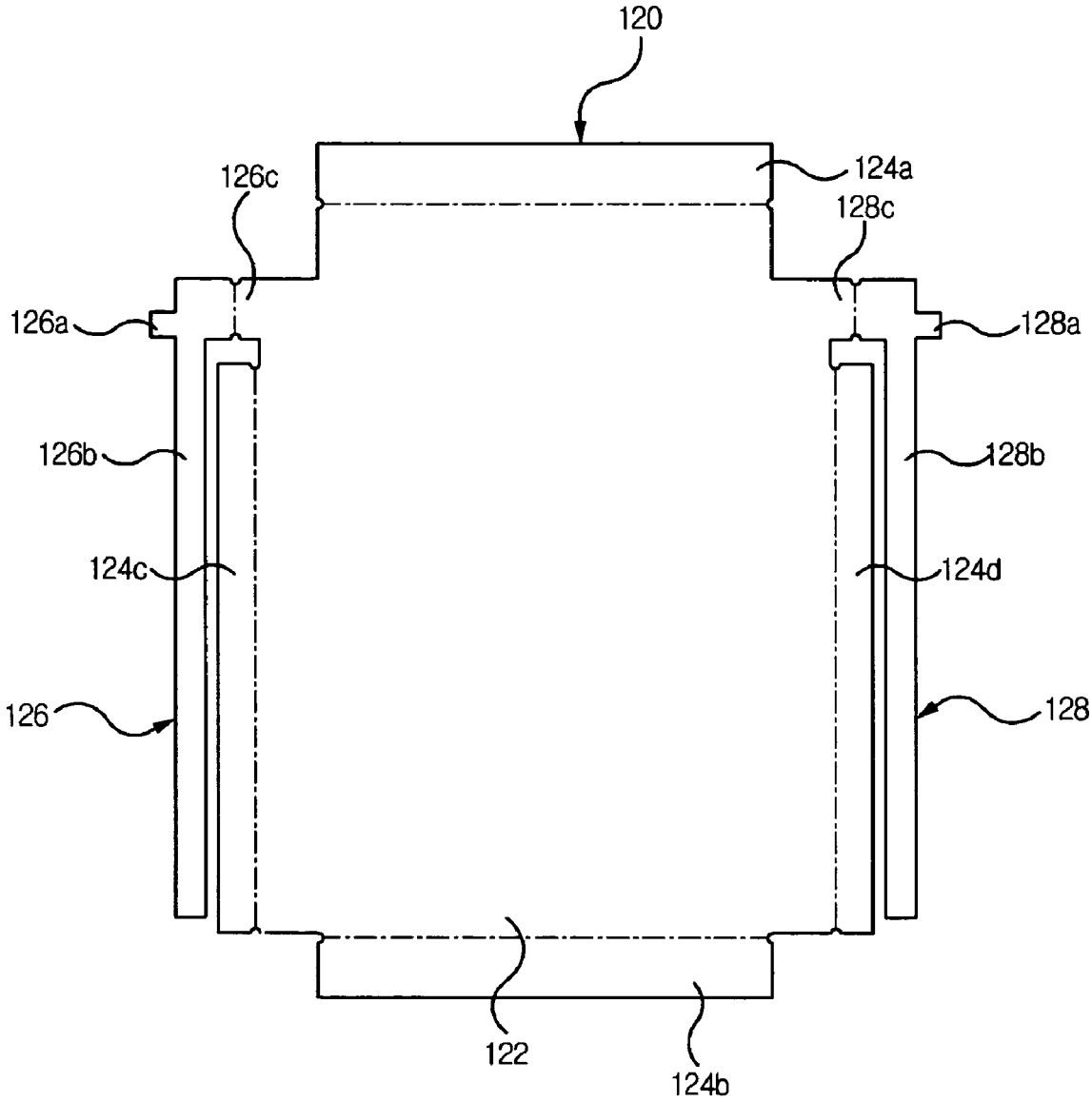
FIG. 2 is a planar view showing an unfold shield can type antenna used in a wireless communication module of the invention.
Figure 3:
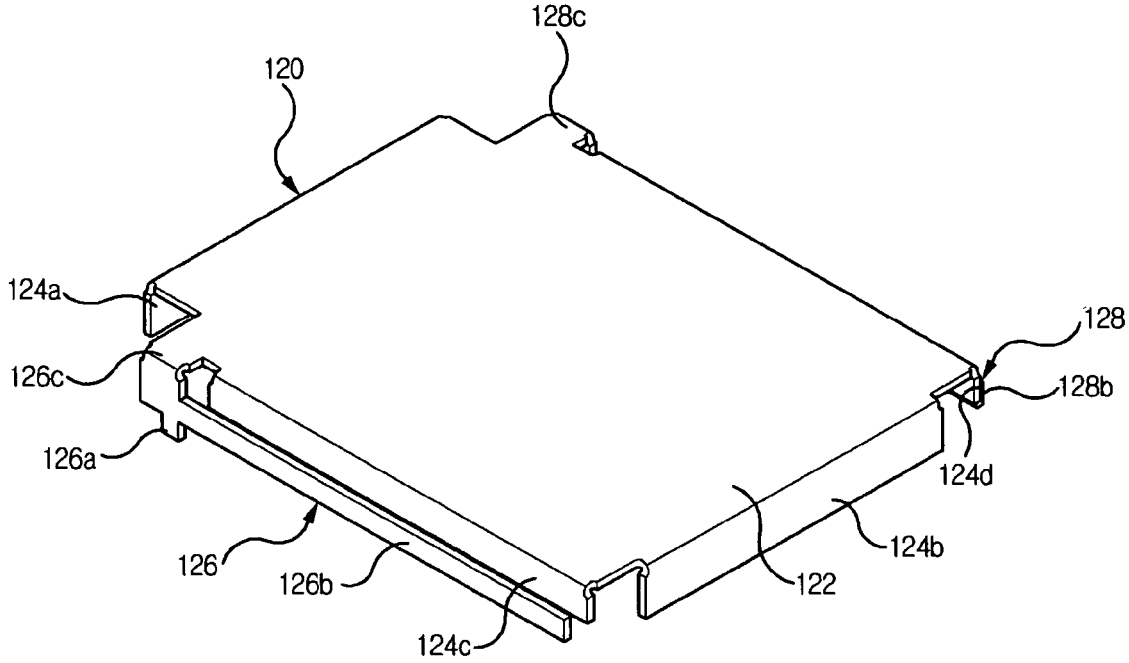
FIG. 3 is a perspective view showing an extracted part of a shield can antenna used in a wireless communication module of the invention.

FIG. 2 is a planar view showing an unfold shield can type antenna used in a wireless communication module of the present invention, and FIG. 3 is a perspective view showing an extracted part of a shield can antenna used in a wireless communication module of the present invention. As illustrated in FIGS. 2 and 3, for the shield can type antenna 120, a curved part 124*a*, 124*b*, 124*c*, 124*d* is formed by downwardly curving both upper/lower and left/right side surfaces of a ground area 122.

And, in the outer surface of the curved part 124*c*, 124*d*, a first antenna 126 and a second antenna 128 having a power feeding part 126*a*, 128*a* and a radiation patch 126*b*, 128*b* are provided.

The first antenna 126 and the second antenna 128 are connected to the ground area 122 via a connection part 126*c*, 128*c* to be integrally configured.

For a wireless communication module having such a configuration, a communication circuit part 110 comprised of each kind of component including a RF device and an integrated chip, etc. may be realized.

In a case of fixing a shield can type antenna 120 to a module substrate 100, components forming the communication circuit part 110 may be in the inner side of a space comprised of a ground area 122 and a curved part 124*a*, 124*b*, 124*c*, 124*d*.

Figure 4:
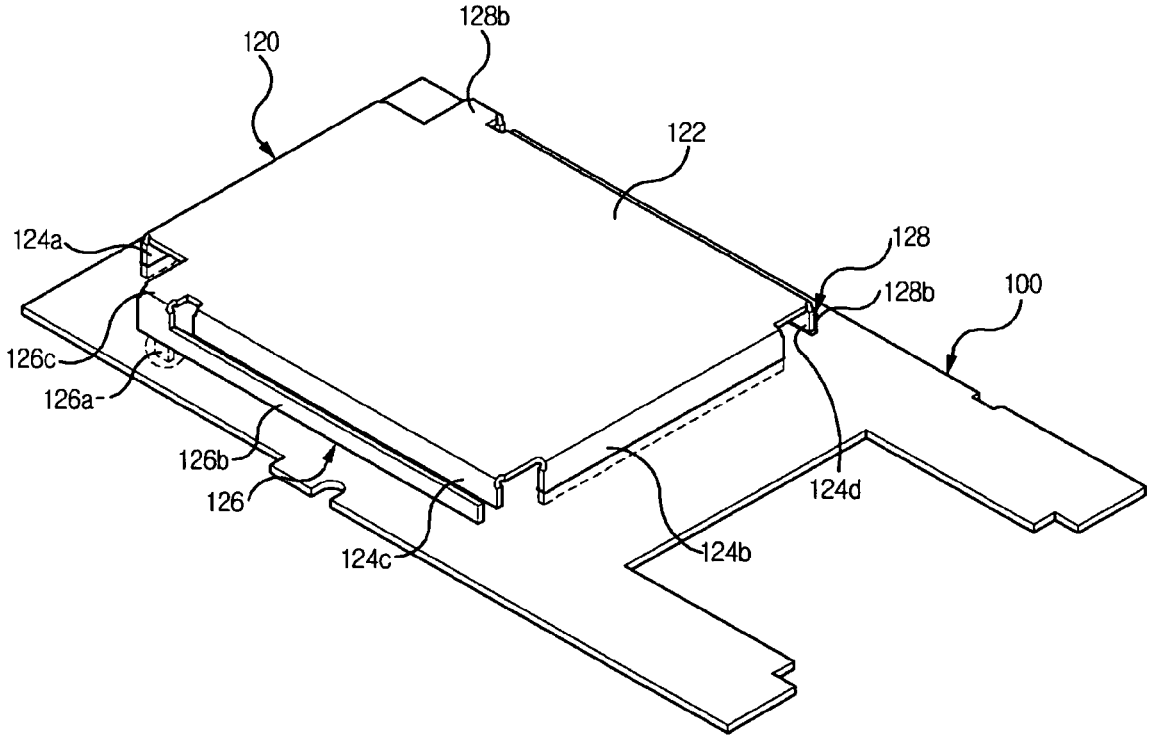
FIG. 4 is a perspective view showing a status of a shield can antenna mounted on a module substrate, used in a wireless communication module of the invention.

FIG. 4 is a perspective view showing a status a shield can type antenna used in a wireless communication module of the invention is mounted on a module substrate, and as shown in FIG. 4, a curved part 124*a*, 124*b* positioned at the upper/lower part of the ground area 122 is electrically connected to a ground pattern formed in the bottom surface of a module substrate 100, via the module substrate 100.

A power feeding part 126*a*, 128*a* of the first antenna 126 and the second antenna 128 is electrically connected to a power feeding pattern 400 of the communication circuit part 110, via the module substrate 100.

In a shield can type antenna 120 of the present invention as described above and in the inner side space comprised of a ground area 122 and a curved part 124*a*, 124*b*, 124*c*, 124*d*, a shield can type antenna 120 is fixed to a module substrate 100 to shield a communication circuit part 110 provided with each kind of component including a RF device or an integrated chip, etc.

The ground area 122 and the curved part 124*a*, 124*b*, 124*c*, 124*d* are formed of metal material, and a curved part 124*a*, 124*b* is electrically connected to a ground pattern via the module substrate 100.

Hence, the ground area 122 and the curved part 124*a*, 124*b*, 124*c*, 124*d* performs a ground function to block electronic waves produced from a communication circuit part 110 and thus to prevent it from leaking outside.

And, at both left/right side of the ground area 122, a power feeding part 126*a*, 128*a* and a radiation patch 126*b*, 128*b* are provided, and a first antenna 126 and a second antenna 128 integrally connected to the ground area 122 via a connection part 126*c*, 128*c* are provided.

The first antenna 126 and the second antenna 128 operate as a PIFA (Planar Inverted-F Antenna) including a power feeding part 126*a*, 128*a* and a ground part in addition to a radiation patch 126*b*, 128*b*. That is, it is an antenna designed to resonate at a desirable frequency band by adjusting the size of a radiation patch 126*b*, 128*b* and the length and position of a power feeding part 126*a*, 128*a*.

The first antenna 126 and the second antenna 128 are arranged at both side surfaces of a ground area 122, respectively, a power feeding part 126*a*, 128*a* is connected to a power feeding pattern via the module substrate 100, and a connection part 126*c*, 128*c* is connected to a ground area 122 as a ground pin.

Therefore, the first antenna 126 and the second first 128 receives a current supplied by the module substrate 100 through a power feeding part 126*a*, 128*a* to resonate at a set frequency band, thereby transceiving a wireless signal processed through a communication circuit part 110, and being connected to a ground area 122 through a connection part 126*c*, 128*c* for earthing.

In the present invention described above, of the first antenna 126 and the second antenna 128, the first antenna 126 may be used as a main antenna transmitting/receiving a wireless antenna and the second antenna 128 may be used as a diversity antenna receiving a wireless antenna, and as design methodologies mounting of only one antenna may be possible.

While the present invention has been described in detail through representative embodiments in the above part, those skilled in the art would understand that various modifications can be made in the described embodiment without departing from the scope of the present invention.

Therefore, the scope of the present invention rights should not be restricted to the described embodiment, but should be defined by the accompanying claims and its equivalents.

What is claimed is:

1. A wireless communication module, comprising:

a module substrate provided with components of a communication circuit part and having a ground pattern and a power feeding pattern; and a shield can type antenna provided on the module substrate, wherein the shield can type antenna comprises:

a ground area;

a plurality of curved parts formed by downwardly curving both up/down and left/right side surfaces of the ground area; and an antenna part provided at the outer side of the curved part formed at both left/right side surfaces of the ground area.

2. The wireless communication module as claimed in claim 1, wherein curved parts respectively downwardly curved at the upper and lower parts of the ground area are electronically connected to the ground pattern via the module substrate.

3. The wireless communication module as claimed in claim 1, wherein components of the communication circuit part provided on the module substrate are positioned within a space part forming of the ground area and the plurality of curved parts to shield electronic waves produced from the communication circuit part.

4. The wireless communication module as claimed in claim 1, wherein the antenna part comprises:

a radiation patch positioned in parallel with curved parts downwardly curved at both left/right side surfaces of the ground area;

a power feeding part connecting the power feeding pattern to the radiation patch; and a connection part connecting the radiation patch to the ground area to be integrally configured.

5. The wireless communication module as claimed in claim 1, wherein the antenna part comprises a PIFA (Planar Inverted-F Antenna).

6. The wireless communication module as claimed in claim 1, wherein the antenna part comprises a first antenna and a second antenna, respectively parallel disposed with curved parts downwardly curved at both left/right side surfaces of the ground area.

7. The wireless communication module as claimed in claim 6, wherein each of the first antenna and the second antenna includes:

a radiation patch parallel positioned with a respective curved part downwardly curved at both left/right side surfaces of the ground area;

a power feeding part connecting the power feeding pattern to the radiation patch; and a connection part connecting the radiation patch and the ground area to be integrally configured.

8. The wireless communication module as claimed in claim 4, wherein the power feeding part is electrically connected to the power feeding part via the module substrate.

9. The wireless communication module as claimed in claim 5, wherein each of the first antenna and the second antenna includes a PIFA (Planar Inverted-F Antenna).

10. The wireless communication module as claimed in claim 5, wherein the first antenna is a main antenna transmitting/receiving a wireless signal, and the second antenna is a diversity antenna receiving a wireless signal.

* * * * *